US006837798B1

(12) United States Patent
Medcalf

(10) Patent No.: US 6,837,798 B1
(45) Date of Patent: Jan. 4, 2005

(54) PUTTING PRACTICE TOOL AND GAME

(76) Inventor: Roger K. Medcalf, 156A Upminster Road, Upminster (GB), RM 14 2RB ( * ) Notice: Subject to any disclaimer, the term of this patent is extended or adjusted under 35 U.S.C. 154(b) by 0 days.

(21) Appl. No.: 10/661,205

(22) Filed: Sep. 15, 2003

(51) Int. Cl.[7] ..... A63B 69/56
(52) U.S. Cl. ..... 473/157; 473/185; 473/409
(58) Field of Search ..... 473/157–171, 473/185, 409

(56) References Cited

U.S. PATENT DOCUMENTS 1,914,365 A * 6/1933 Ford ..... 473/157
3,342,494 A * 9/1967 Talley, Jr. ..... 473/159
3,584,877 A * 6/1971 Florian ..... 473/159
4,743,026 A * 5/1988 Eady ..... 473/162
4,877,250 A * 10/1989 Centafanti ..... 473/157
4,934,704 A 6/1990 Mazer
5,203,566 A 4/1993 Ricigliano
5,316,302 A * 5/1994 Sedberry ..... 473/185
5,419,541 A 5/1995 Weber
5,749,789 A 5/1998 Karl
8,038,808 3/2000 Dumas
6,575,841 B1 * 6/2003 Erdoes et al. ..... 473/160

* cited by examiner

*Primary Examiner*—Mark S. Graham

(57) ABSTRACT

A putting practice tool and game for PURPOSE includes a mat having an upper surface. The mat has a front edge, a back edge, a first side edge and a second side edge. A tee area is defined adjacent to the back edge. A plurality of green indicia is positioned on the upper surface of the mat. Each of the green indicia defines a green. Each of the greens is spaced from each other and is positioned between the tee area and the back edge. A player utilizes a putter and ball such that the ball may be putt with the putter. The player hits a selected series of putts to designated areas from the tee area by the player for each of the greens in turn. The player adds additional strokes for putts going errant with respect to the designated area. At least one putt of the series of putts is directed into the green for which the series of putts is being played.

11 Claims, 4 Drawing Sheets

46

| TINY NINE SCORECARD | | | | |
|---|---|---|---|---|
| hole | name | par | Driving zone shots | score |
| 1 | The green gopher | 4 | DZ1<br>DZ2 | |
| 2 | Puttafur | 4 | DZ1<br>DZ2 | |
| 3 | S'putt'nik | 2 | | |
| 4 | Route 66 | 5 | DZ1<br>DZ2 / DZ1 | |
| 5 | Captain's corner | 4 | DZ1<br>DZ2 | |
| 6 | Drive to distraction | 4 | DZ1<br>DZ2 | |
| 7 | 7th heaven | 3 | DZ1 | |
| 8 | Dingly dangly dell | 3 | DZ1 | |
| 9 | 'Jackputt' | 2 | | |
| | par | 33 | total | |

PUTTING PRACTICE TOOL AND GAME

BACKGROUND OF THE INVENTION

1. Field of the Invention

The present invention relates to putting games and more particularly pertains to a new putting game for providing an entertaining way for a person to practice their putting.

2. Description of the Prior Art

The use of putting games is known in the prior art. U.S. Pat. No. 5,419,561 describes a limited acreage golf course in which a person utilizes only a putter. Another type of putting game is U.S. Pat. No. 5,203,566 which simulates a golf course by using a miniature golf course which is meant to played indoors.

While these devices fulfill their respective, particular objectives and requirements, the need remains for a device which can simulate many types of puts while taking up the least amount of space.

SUMMARY OF THE INVENTION

The present invention meets the needs presented above by providing a mat having a plurality of greens thereon along with an over-laid first and second zone which simulates long shots.

Another object of the present invention is to provide a new putting game that uses one tee area from which to hit at various targets, thus eliminated much of the room needed by prior devices.

Still another object of the present invention is to provide a new putting game that allows a person to practice a variety of lengths of putts while also entertaining the person who is practicing.

To this end, the present invention generally comprises a mat having an upper surface. The mat has a front edge, a back edge, a first side edge and a second side edge. A tee area is defined adjacent to the back edge. A plurality of green indicia is positioned on the upper surface of the mat. Each of the green indicia defines a green. Each of the greens is spaced from each other and is positioned between the tee area and the back edge. A player utilizes a putter and ball such that the ball may be putt with the putter. The player hits a selected series of putts to designated areas from the tee area by the player for each of the greens in turn. The player adds additional strokes for putts going errant with respect to the designated area. At least one putt of the series of putts is directed into the green for which the series of putts is being played.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
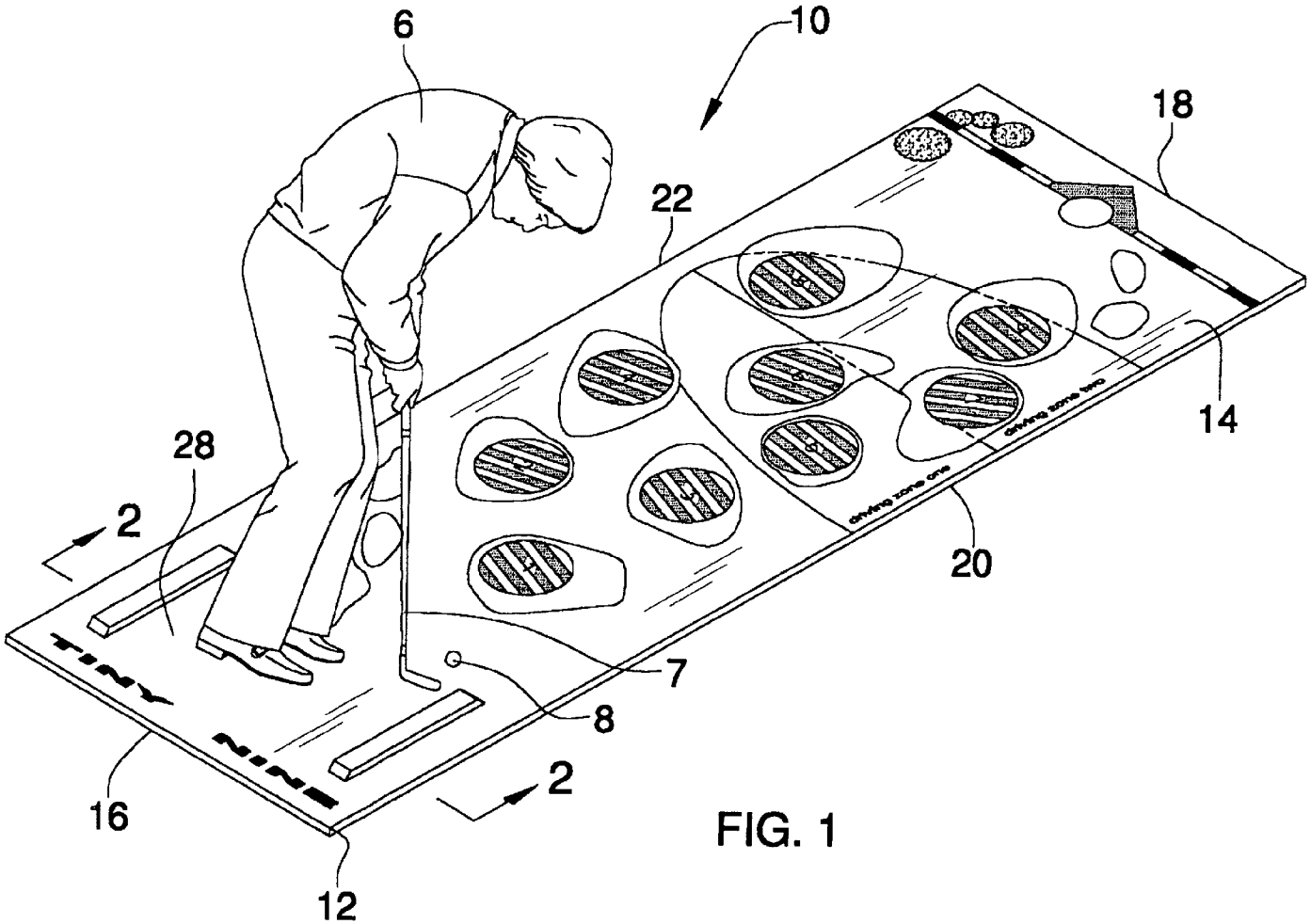
FIG. 1 is a schematic perspective in-use view of a putting practice tool and game according to the present invention.

With reference now to the drawings, and in particular to FIGS. 1 through 5 thereof, a new putting game embodying the principles and concepts of the present invention and generally designated by the reference numeral 10 will be described.

As best illustrated in FIGS. 1 through 5, the putting practice tool and game 10 generally comprises a mat 12 having an upper surface 14. The mat 12 has a front edge 16, a back edge 18, a first side edge 20 and a second side edge 22. The upper surface 14 preferably includes a synthetic turf material 24 having an elastomeric backing 26. A tee area 28 is defined adjacent to the back edge 18. A plurality of green indicia 30 is positioned on the upper surface 14 of the mat 12. Each of the green indicia 30 defines a green. Each of the greens, or green indicia 30, is spaced from each other and is positioned between the tee area 28 and the back edge 18. The plurality of green indicia 30 ideally includes nine greens 30. Number indicia 32 for numbering the greens 30 is positioned in each of the greens 30. Preferably, the number indicia 32 increases from the greens 30 positioned adjacent to the tee area 28 to the greens 30 positioned adjacent to the back edge 18. A final marker 34 is positioned on the upper surface 14. The final marker 34 is positioned adjacent to the back edge 18 and is centrally disposed with respect to the first 20 and second 22 side edges. Ideally, the final marker 34 is a golf cup having a diameter generally equal to 4½ inches. A first zone 36 is defined on the upper surface 14 and is positioned generally nearer the back edge 18 than the front edge 16. A second zone 38 is defined on the upper surface 14 and positioned adjacent to the first zone 36 and between the first zone 36 and the back edge 18. Preferably, each of the first 36 and second 38 zones extends from the first side edge 20 toward the second side edge 22 in an elliptical pattern.

Additional indicia on the mat preferably include water hazards or sand bunkers 42. The tee area 28 may include side markers 44 to further designate where the tee area 28 is positioned.

A score card 46 will generally be provided for indicating what types of shots a player will need to take as well as give a score indication for par for each hole.

Rules of the Game

The game 10 may be played by a plurality of players 6, though the rules are the same for one or more and thus only one player will be considered for this example. The player 6 uses a conventional putter 7 and a ball 8, or golf ball, such that the ball 8 may be putt with the putter.

Figures 2, 3:
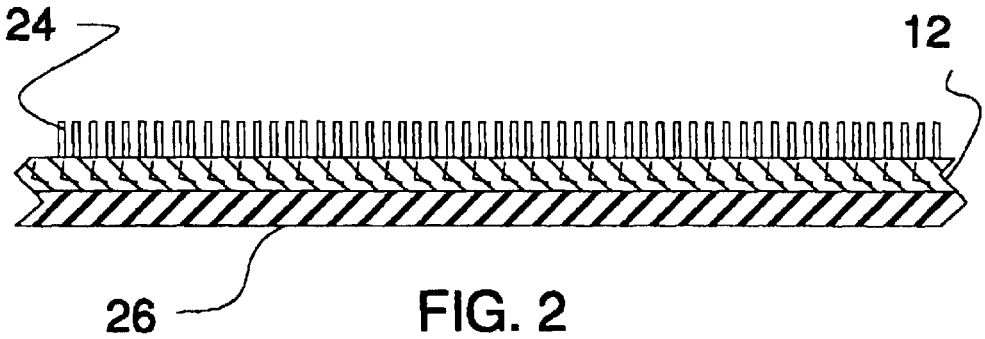
FIG. 2 is a schematic cross-sectional view taken along line 2—2 of FIG. 1 of the present invention.
FIG. 3 is a schematic plan view of a scorecard of the present invention.
Figure 4:
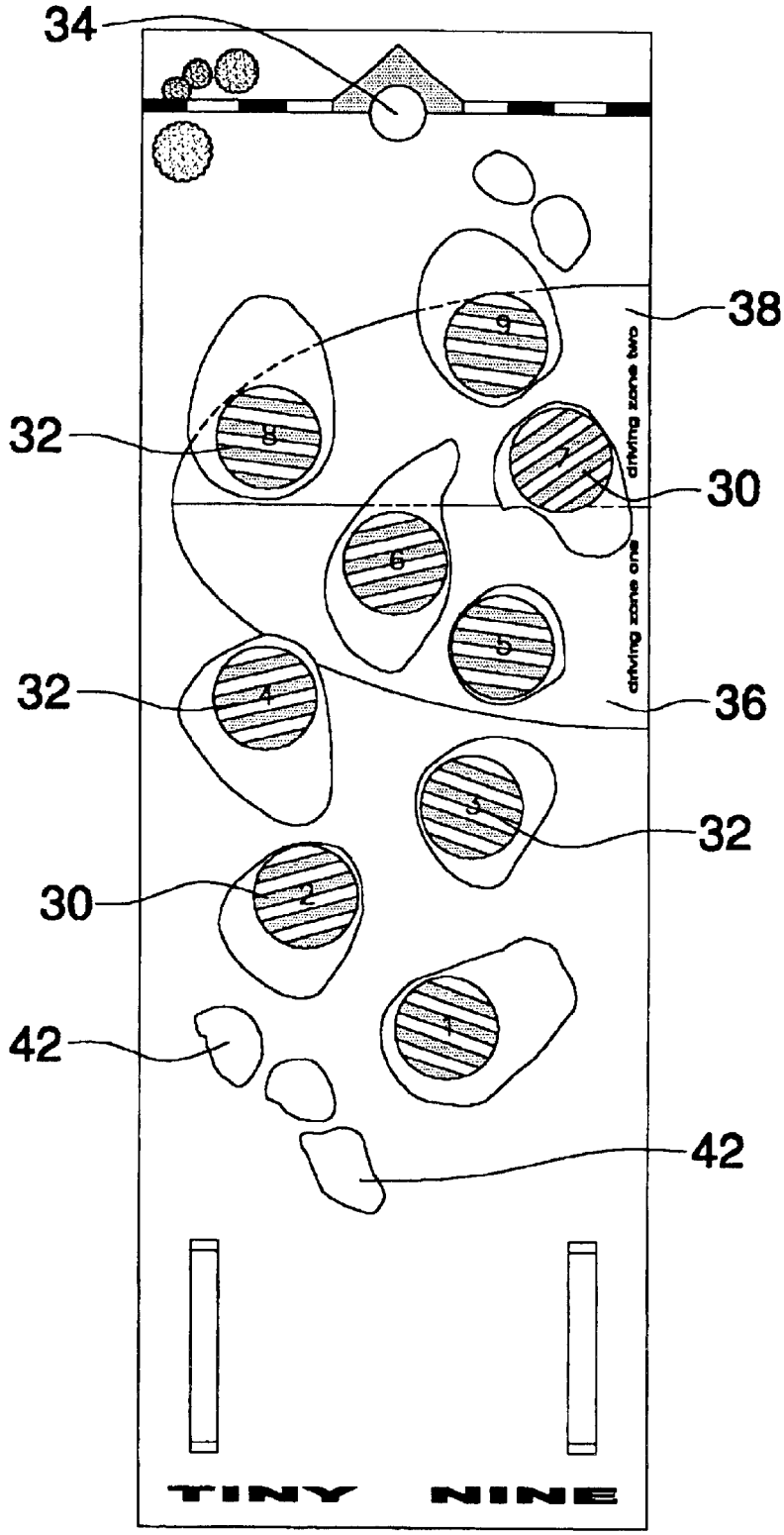
FIG. 4 is a schematic plan view of the present invention.
Figure 5:
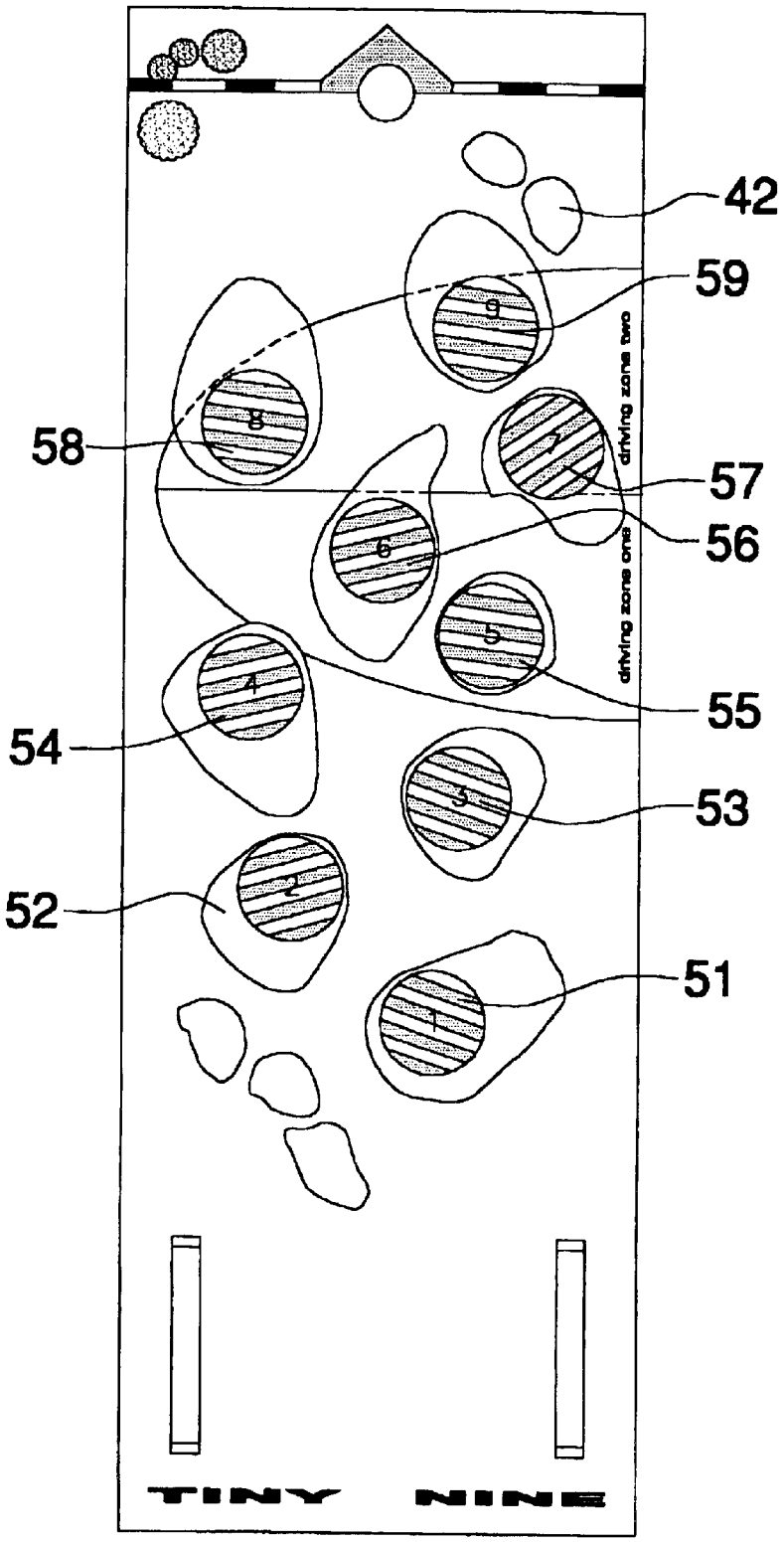
FIG. 5 is a schematic plan view of the present invention.

The player 6 hits a selected series of putts to designated areas from the tee area 28 for each of the greens 30 in turn. Each green 30 will have its own series of shots which will be indicated as depicted in FIG. 3 wherein "DZ" designates the zone 36 or 38 that the player is to hit into. Thus, DZ1 is the first zone 36 and DZ2 is the second zone 38. Each of the series includes at least one putt into the first 36 or second 38 zones, at least one putt into the green 30 for which the series of putts is being played, and at least one putt through, or onto, the final marker 34. When hitting into the first 36 or second 38 zones or into one of the greens, the shot is only considered good and not errant if the ball stops in the designated area. However, putts designated through the final marker 34 are good regardless of whether or not the ball stops on the final marker 34, thus a good putt is easier to determine if the final marker 34 is a golf cup, or hole. In one embodiment, the player 6 adds a stroke for each putt hit and adds an additional stroke for each putt hit errantly with respect to the designated area, and then the player 8 hits onto the next designated area in the series of putts.

A second embodiment of the game 10 causes the player 6 to continue to hit the same putt until successful before moving onto the next designated area and counting each putt taken. Alternatively, the player 6 may only add up strokes for each errant put. In either method, it is important that the player 6 either continue to take the same putt until successful while counting each stroke, or adding a stroke for an errant putt and moving onto the next one. Also, the player 6 always hits the ball 8 from the tee area 28 instead of from one designated area to another. In this manner, the player 6 simulates long shots and shorter shots as generally required in a round of conventional golf.

The selected series of putts preferably includes:

a first green series including a first putt into the first zone 36, a second putt into the second zone 38, a third putt into a first one of the greens 51 and a fourth putt through the final marker 34;

a second green series including a first putt into the first zone 36, a second putt into the second zone 38, a third putt into a second one of the greens 52, and a fourth putt through the final marker 34;

a third green series including a first putt into a third one of the greens 53, and a second putt through the final marker 34;

a fourth green series including a first putt into the first zone 36, a second putt into the second zone 38, a third putt into the first zone 36, a fourth putt into a fourth one of the greens 54 and a fifth putt through the final marker 34;

a fifth green series including a first putt into the first zone 36, a second putt into the second zone 38, a third putt into a fifth one of the greens 55 and a fourth putt through the final marker 34;

a sixth green series including a first putt into the first zone 36, a second putt into the second zone 38, a third putt into a sixth one 56 of the greens and a fourth putt through the final marker 34;

a seventh green series including a first putt into the first zone 36, a second putt into a seventh one of the greens 57 and a third putt through the final marker 34;

an eight green series including a first putt into the first zone 36, a second putt into an eighth one of the greens 58 and a third putt through the final marker 34; and a ninth green series including a first putt into a ninth one of the greens 59 and a second putt through the final marker 34.

However, it should be understood that the preceding selected series is for example only. What is important is that the series alternate to ensure that a person using the game 10, while deriving enjoyment therefrom, practices varying lengths of putts from one putt to the next putt. This alteration of distances gives a person greater practice at learning the speed of putts which is truer to actual golf where not all putts are of the same length.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

I claim:

1. A method of playing a putting game comprising the steps of:

providing a mat having an upper surface, said mat having a front edge, a back edge, a first side edge and a second side edge, a tee area being defined adjacent to said back edge, a plurality of green indicia being positioned on said upper surface of said mat, each of said green indicia defining a green, each of said greens being spaced from each other and being positioned between said tee area and said back edge;

number indicia for numbering said greens being positioned in each of said greens, wherein said number indicia increases from said greens positioned adjacent to said tee area to said greens positioned adjacent to said back edge;

providing a player; and hitting a selected series of putts with a putter and a golf ball to designated areas from said tee area by said player for each of said greens in turn, wherein said player adds additional strokes for putts going errant with respect to the designated area, wherein at least one putt of said series of putts is directed into the green for which the series of putts is being played.

2. The method of playing a putting game according to claim 1, wherein said plurality of green indicia includes nine greens.

3. The method of playing a putting game according to claim 1, further including a final marker being positioned on said upper surface, said final marker being positioned adjacent to said back edge and being centrally disposed with respect to said first and second side edges, wherein each of said series of putts ending with a putt from said tee area through said final marker.

4. The method of playing a putting game according to claim 3, further including a first zone being defined on said upper surface and positioned generally nearer said back edge than said front edge, a second zone being defined on said upper surface and positioned adjacent to said first zone and being positioned between said back edge and said first zone, wherein each of said series of putts including at least one putt to said first zone or said second zone.

5. The method of playing a putting game according to claim 1, further including a first zone being defined on said upper surface and positioned generally nearer said back edge than said front edge, a second zone being defined on said upper surface and positioned adjacent to said first zone and being positioned between said back edge and said first zone, wherein each of said series of putts including at least one putt to said first zone or said second zone.

6. A method of playing a putting game comprising the steps of:

providing a mat having an upper surface, said mat having a front edge, a back edge, a first side edge and a second side edge, a tee area being defined adjacent to said back edge, a plurality of green indicia being positioned on said upper surface of said mat, each of said green indicia defining a green, each of said greens being spaced from each other and being positioned between said tee area and said back edge, said plurality of green indicia including nine greens, number indicia for numbering said greens being positioned in each of said greens, wherein said number indicia increases from said greens positioned adjacent to said tee area to said greens positioned adjacent to said back edge, a final marker being positioned on said upper surface, said final marker being positioned adjacent to said back edge and being centrally disposed with respect to said first and second side edges, a first zone being defined on said upper surface and positioned generally nearer said back edge than said front edge, a second zone being defined on said upper surface and positioned adjacent to said first zone and between said back edge and said first zone;

providing a player;

hitting a selected series of putts with a putter and a ball to designated areas from said tee area by said player for each of said greens in turn, each of said series including at least one putt into said first or second zones, at least one putt into the green for which the series of putts is being played, and at least one putt through the final marker, said player adding a stroke for each putt hit and an additional stoke for each putt hit errantly with respect to the designated area, said selected series of putts including;

a first green series including a first putt into said first zone, a second putt into said second zone, a third putt into a first one of said greens and a fourth putt through said final marker;

a second green series including a first putt into said first zone, a second putt into said second zone, a third putt into a second one of said greens, and a fourth putt through said final marker;

a third green series including a first putt into a third one of said greens, and a second putt through said final marker;

a fourth green series including a first putt into said first zone, a second putt into said second zone, a third putt into said first zone, a fourth putt into a fourth one of said greens and a fifth putt through said final marker;

a fifth green series including a first putt into said first zone, a second putt into said second zone, a third putt into a fifth one of said greens and a fourth putt through said final marker;

a sixth green series including a first putt into said first zone, a second putt into said second zone, a third putt into a sixth one of said greens and a fourth putt through said final marker;

a seventh green series including a first putt into said first zone, a second putt into a seventh one of said greens and a third putt through said final marker;

an eight green series including a first putt into said first zone, a second putt into an eighth one of said greens and a third putt through said final marker; and a ninth green series including a first putt into a ninth one of said greens and a second putt through said final marker.

7. A method of playing a putting game comprising the steps of:

providing a mat having an upper surface, said mat having a front edge, a back edge, a first side edge and a second side edge, a tee area being defined adjacent to said back edge, a plurality of green indicia being positioned on said upper surface of said mat, each of said green indicia defining a green, each of said greens being spaced from each other and being positioned between said tee area and said back edge, a final marker being positioned on said upper surface, said final marker being positioned adjacent to said back edge and being centrally disposed with respect to said first and second side edges, wherein each of said series of putts ending with a putt from said tee area through said final marker;

providing a player;

hitting a selected series of putts with a putter and a golf ball to designated areas from said tee area by said player for each of said greens in turn, wherein said player adds additional strokes for putts going errant with respect to the designated area, wherein at least one putt of said series of putts is directed into the green for which the series of putts is being played.

8. The method of playing a putting game according to claim 7, wherein said plurality of green indicia includes nine greens.

9. The method of playing a putting game according to claim 8, further including number indicia for numbering said greens being positioned in each of said greens, wherein said number indicia increases from said greens positioned adjacent to said tee area to said greens positioned adjacent to said back edge.

10. The method of playing a putting game according to claim 9, further including a first zone being defined on said upper surface and positioned generally nearer said back edge than said front edge, a second zone being defined on said upper surface and positioned adjacent to said first zone and being positioned between said back edge and said first zone, wherein each of said series of putts including at least one putt to said first zone or said second zone.

11. The method of playing a putting game according to claim 7, further including a first zone being defined on said upper surface and positioned generally nearer said back edge than said front edge, a second zone being defined on said upper surface and positioned adjacent to said first zone and being positioned between said back edge and said first zone, wherein each of said series of putts including at least one putt to said first zone or said second zone.

* * * * *